US005442847A

United States Patent [19]

Semiatin et al.

[11] Patent Number: 5,442,847

[45] Date of Patent: Aug. 22, 1995

[54] METHOD FOR THERMOMECHANICAL PROCESSING OF INGOT METALLURGY NEAR GAMMA TITANIUM ALUMINIDES TO REFINE GRAIN SIZE AND OPTIMIZE MECHANICAL PROPERTIES

[75] Inventors: Sheldon L. Semiatin, Dayton, Ohio; Sami M. El Soudani, Cerritos, Calif.; Donald C. Vollmer, Columbus; Clarence R. Thompson, Worthington, both of Ohio

[73] Assignee: Rockwell International Corporation, Seal Beach, Calif.

[21] Appl. No.: 251,065

[22] Filed: May 31, 1994

[51] Int. Cl.[6] ..... B21B 1/46

[52] U.S. Cl. ..... 29/527.5; 148/670

[58] Field of Search ..... 148/670, 671, 421; 29/527.7, 527.3, 526.2, 526.3, 526.4

[56] References Cited

U.S. PATENT DOCUMENTS

| | | | |
|---|---|---|---|
| 2,950,191 | 8/1960 | Vordahl | 148/670 |
| 3,489,617 | 1/1970 | Wuerfel | 148/670 |
| 4,924,585 | 5/1990 | Imai et al. | 29/527.7 |
| 4,941,927 | 7/1990 | Hickey, Jr. et al. | 29/527.7 |
| 5,082,506 | 1/1992 | Huang | 148/670 |
| 5,264,055 | 11/1993 | Champin et al. | 148/670 |
| 5,277,718 | 1/1994 | Paxson et al. | 148/670 |
| 5,350,466 | 9/1994 | Larsen, Jr. et al. | 148/670 |

*Primary Examiner*—Irene Cuda
*Assistant Examiner*—Mark V. Butler
*Attorney, Agent, or Firm*—Lawrence N. Ginsberg; Charles T. Silberberg

[57] ABSTRACT

A method for thermomechanically processing gamma titanium aluminide alloy wrought products comprises the following steps: a) a near gamma titanium aluminide alloy ingot is cast; b) the ingot is hot isostatically pressed (HIP'ed) to seal off casting defects; c) the HIP'ed ingot is prepared into suitable forging preforms with or without intermediate homogenization heat treatment; d) the forging preforms are isothermally forged into suitable end product preforms at temperatures sufficiently close to the phase line between the alpha+gamma and alpha-two+gamma phase fields so as to break down the ingot microstructure and to yield a largely equiaxed gamma microstructure; and e) the end product preforms are processed into the desired wrought end products through a controlled rolling process or a closed-die forging operation.

16 Claims, 7 Drawing Sheets

METHOD FOR THERMOMECHANICAL PROCESSING OF INGOT METALLURGY NEAR GAMMA TITANIUM ALUMINIDES TO REFINE GRAIN SIZE AND OPTIMIZE MECHANICAL PROPERTIES

STATEMENT OF GOVERNMENT INTEREST

This invention was made with Government support under Contract No. F33657-86-C-2127 awarded by the United States Air Force. The Government has certain rights in the invention.

BACKGROUND OF THE INVENTION

The present invention relates generally to the processing of near-gamma titanium aluminides, and more particularly to a method for thermomechanically processing near-gamma titanium aluminides so as to break down the ingot coarse microstructure with either partial or full homogenization of the microstructure and to yield a largely equiaxed gamma microstructure.

The two phase near-gamma titanium aluminides are attractive candidates for applications requiring low density and high strength at elevated temperatures. One of the main drawbacks limiting their application is their low room temperature tensile ductility. It is known that one of the prime methods of improving ductility is to refine the gamma grain size of these materials.

FIG. 1 shows tensile data obtained in this investigation for a near-gamma titanium aluminide (Ti-48Al-2.5Nb-0.3Ta aim composition, in atomic percent), which illustrates the important trends. The data are for sheet samples, all of which contain a nominally equiaxed gamma grain structure, but some contain coarse grains (lower ductility data) and some contain finer grains (higher ductility values). To be precise the ductility values around 0.3 percent are for samples with a bimodal grain structure, but a peak grain size of 50 μm, while those samples with ductilities around 0.8 percent had a uniform fine grain size of 15 μm.

Two main techniques presently exist for primary consolidation of near-gamma titanium aluminides: powder metallurgy and ingot metallurgy processes. Powder metallurgy processes consist of some method of producing powder which is then consolidated by hot isostatic pressing (HIP'ing) followed by extrusion, etc. Such techniques are expensive, and even though such processes avoid the segregation of alloying elements and phases (i.e. alpha-two and gamma in the near-gamma titanium aluminides) they suffer from high levels of interstitials (C, O, H, N) which degrade properties, trapped inert gas (e.g., He), and problems with thermally induced porosity (TIP) during processing. Ingot metallurgy materials are fabricated via arc melting, HIP'ing (to seal casting porosity), isothermal forging or extrusion to break down the cast structure, and finish processing (e.g., rolling, superplastic forming, closed-die forging).

Ingot metallurgy processes are much less expensive and have the further advantage of much reduced interstitial levels.

The main drawback of ingot-metallurgy processing of near-gamma titanium aluminides is associated with the slow cooling after casting and the resultant segregation on a microscopic (as well as sometimes on a macroscopic) scale. Microsegregation is manifested by the development of dendritic regions, with an alpha-two/-gamma lamellar two-phase structure, that are the initial solidification products, and interdendritic regions consisting solely of single phase gamma. During subsequent high temperature deformation (e.g., isothermal forging, rolling) and thermal processes, the cast structure is broken down to yield a refined structure. However, because of the difficulty of homogenization of the gamma phase even with deformation, broken down or wrought products exhibit the signature of the microsegregation developed in the ingot casting.

The signature observed by the present inventors consists of (1) fine equiaxed grains of gamma+alpha two that have evolved from the prior dendritic, lamellar two-phase region, and (2) regions of single-phase, coarse gamma grains. The coarse gamma grains are recrystallized from the prior interdendritic gamma, but in the absence of a second phase (e.g., alpha-two) have undergone grain growth at the required high processing temperatures. The bimodel grain structure is usually very undesirable.

OBJECTS AND SUMMARY OF THE INVENTION

A primary object of the present invention is to provide a new method for thermomechanical processing of ingot metallurgy gamma titanium aluminides to either alleviate or eliminate micro-segregation in these materials.

Another object is to refine the microstructure of thermomechanically processed ingot metallurgy gamma titanium aluminides and improve their mechanical properties such as strength, ductility and fatigue resistance.

In its broad aspects, the method of the present invention for thermomechanically processing gamma titanium aluminide alloy wrought products comprises the following steps: a) a near gamma titanium aluminide alloy ingot is cast; b) the ingot is hot isostatically pressed (HIP'ed) to seal off casting defects; c) the HIP'ed ingot is prepared into suitable forging preforms; d) the forging preforms are isothermally forged into suitable end product preforms at forging temperatures sufficiently close to the phase line between the alpha+-gamma and alpha-two+gamma phase fields so as to break down the ingot coarse microstructure and to yield a largely equiaxed gamma microstructure; and e) the end product preforms are processed into the desired wrought end products.

A main thrust of the invention deals with partially to fully homogenized microstructures, while a second thrust of the invention deals with enhancing the homogenization of near-gamma titanium alloys through a controlled thermomechanical processing. The invention enhances the ability to obtain a uniform, fine, and stable gamma grain structure. The method of the present invention relies on (1) the use of the alpha phase (at high temperatures) to provide control of microstructure and prevent gamma grain growth, and (2) the use of a thermomechanical processing step either in the alpha phase field or in the alpha+gamma phase field within the temperature range $T_\alpha-40°$ C. to $T_\alpha+70°$ C. (see FIG. 3*a*), where $T_\alpha$ is defined by the alpha transus phase diagram line,.to promote homogenization. The preferred practice within this overall temperature range is as follows: Single phase homogenization at $T_\alpha+20°$ C. to $T_\alpha+50°$ C., or two-phase homogenization at $T_\alpha$ to $T_\alpha-20°$ C. As implied above, the diffusion processes necessary for homogenization are considerably more rapid in the alpha (or disordered) crystal rather than in the gamma (ordered) crystal structure.

In order to achieve these effects in the material system, two product pathways are preferred, which provide two separate processing sequences for producing specific product forms in near-gamma alloys, namely rolled sheet and/or isothermal closed die forged shapes (as discussed below with reference to FIGS. 4 and 5).

Other objects, advantages and novel features of the present invention will become apparent from the following detailed description of the invention when considered in conjunction with the accompanying drawings.

BRIEF DESCRIPTION OF THE DRAWINGS

FIG. 3*a* illustrates the homogenizing and isothermal forging temperature ranges, and FIG. 3*b* illustrates the initial and final rolling temperature ranges.

The same elements or parts throughout the figures are designated by the same reference characters.

DETAILED DESCRIPTION OF THE PREFERRED EMBODIMENTS

Figure 2:
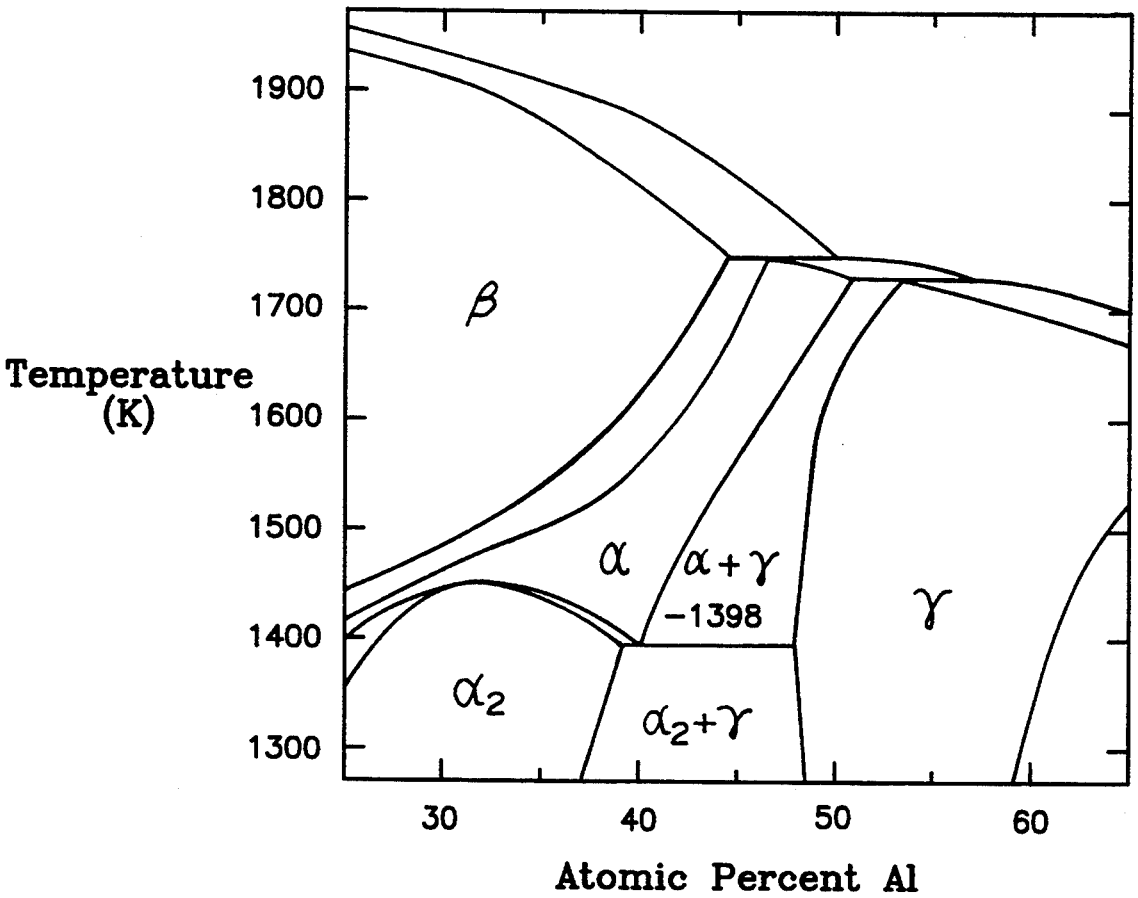
FIG. 2 (PRIOR ART)
FIG. 2 (Prior Art) is an equilibrium titanium-aluminum binary phase diagram in the region of near-gamma titanium aluminides.
Figure 3A:
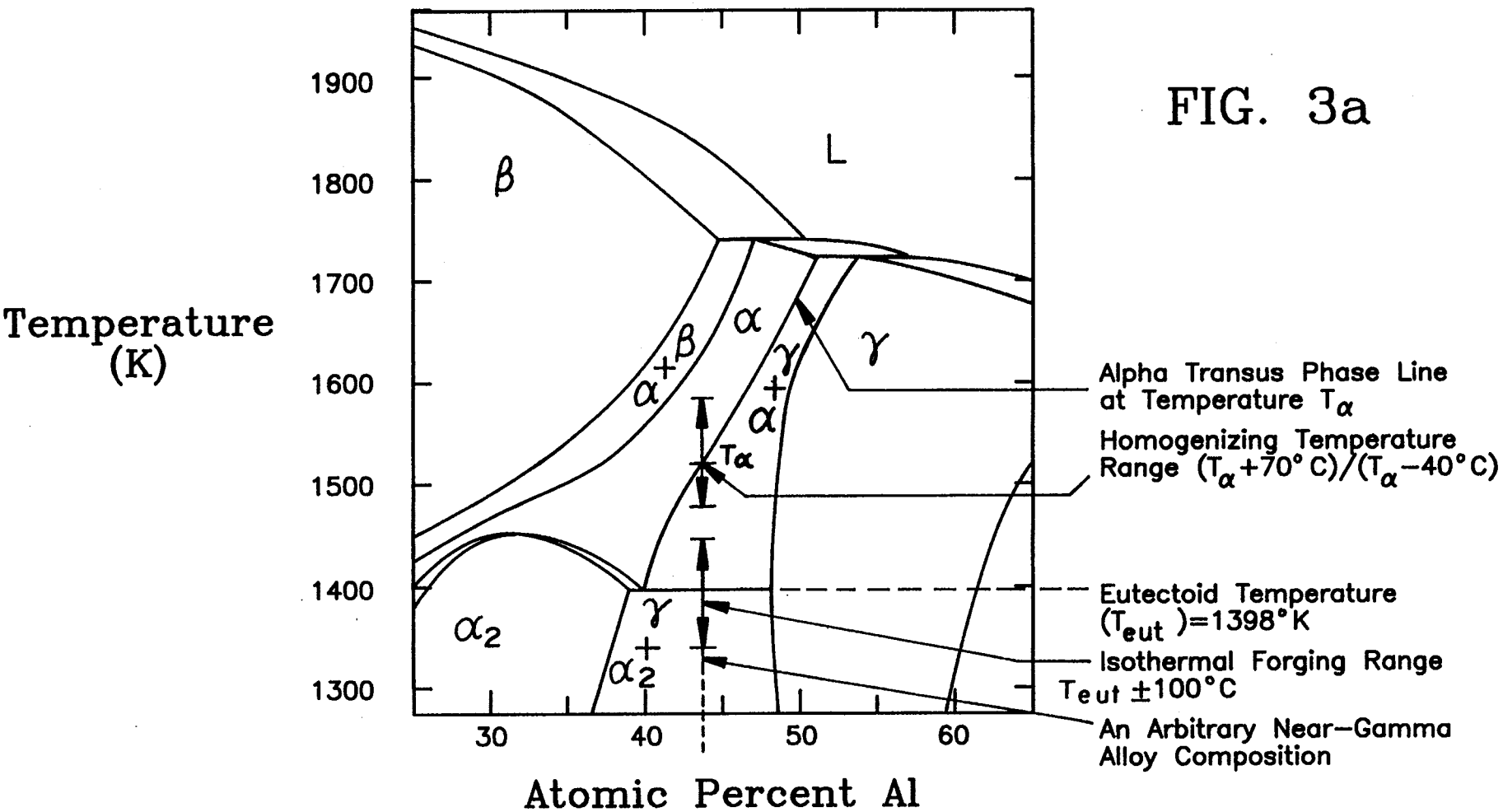
FIGS. 3*a* and 3*b* show close ups of the region of interest in FIG. 2, schematically illustrating various preferred processing temperature ranges.
Figure 3B:
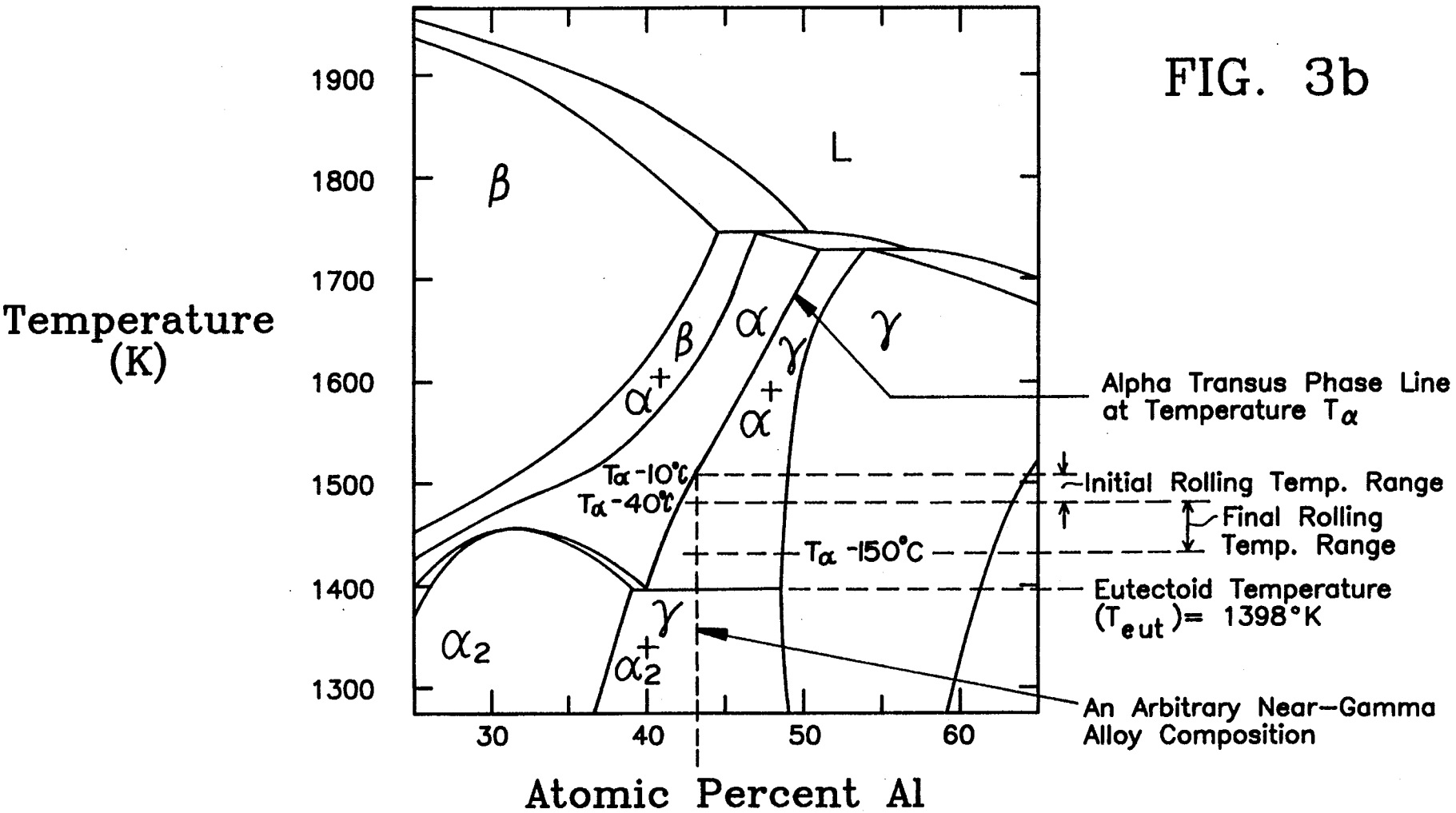
Figure 4:
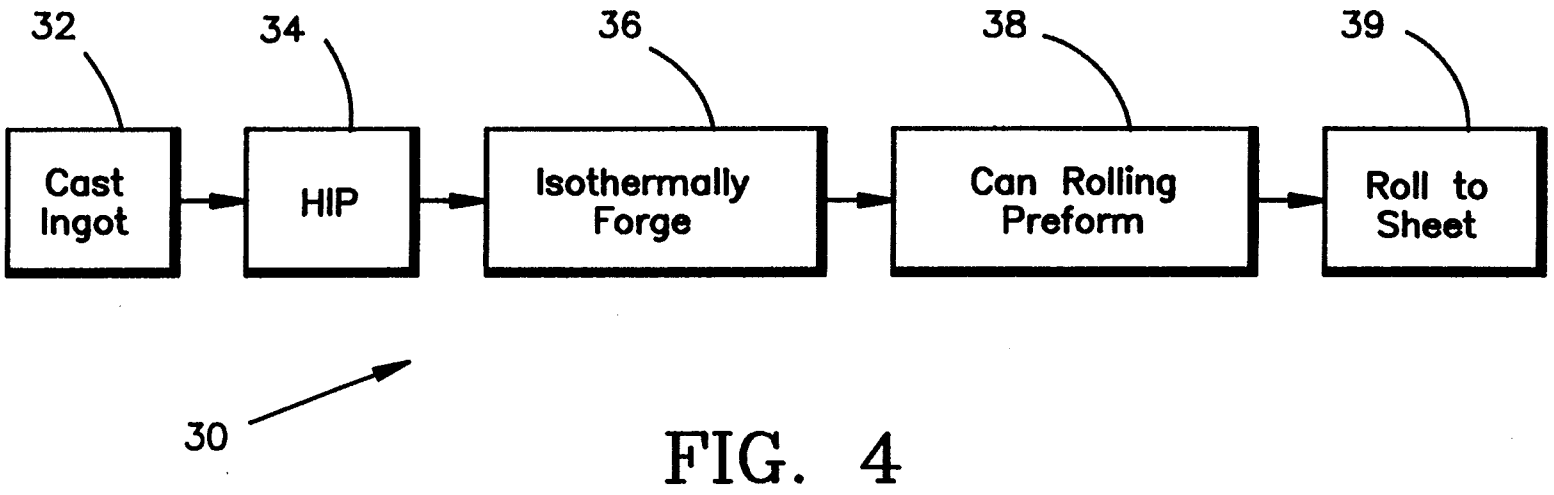
FIG. 4 is a flow diagram of a first preferred product pathway in which sheet products are formed in accordance with the principles of the present invention.

A main thrust of the present invention deals with enhancing the homogenization of near-gamma titanium alloys through controlled thermomechanical processing, hence, obtaining a uniform, fine and stable gamma grain structure. Use of the alpha phase (at high temperature) provides control of the microstructure and prevents gamma grain growth. Use of a thermomechanical processing step in the alpha phase field within the temperature range $T_\alpha$ to $T_\alpha+70°$ C. (see FIG. 3*a*), or in the alpha+gamma field just below the alpha+gamma→alpha transus ($T_\alpha-40°$ C. to $T_\alpha$) promotes homogenization. Implementation of the abovementioned processes is to be executed through either of two processing pathways as described below:

(A) Referring to FIG. 4, a first "product pathway" is illustrated for forming sheet products, this pathway being designated generally as 30. Ingot is cast 32 and then hot isostatically pressed (HIP'ed) 34 to seal the casting porosity. The material is cut into suitable preforms and then isothermally forged/pancaked (36) to break down, but not homogenize, the microstructure at temperatures low in the alpha+gamma phase field, $T_{eut}$ to ($T_{eut}+100°$ C.), with a preferred range $T_{eut}$ to ($T_{eut}+50°$ C.) (see FIG. 3*a*), or high in the alpha-two+-gamma phase field $T_{eut}$ to ($T_{eut}-100°$ C.) with a preferred range $T_{eut}$ to ($T_{eut}-50°$ C.) (see FIG. 3*a*). As used herein $T_{eut}$ refers to the eutectoid temperature, also referred to as the ordering temperature for the alpha phase shown in FIGS. 2 and 3 at about 1398° K. The selected temperature ranges for isothermal forging yield a largely equiaxed gamma structure during hot working.

A controlled rolling/reheating practice is utilized to produce homogeneous microstructure in the sheet materials which can be used in service, with or without subsequent heat treatment, or which can be further fabricated via superplastic sheet forming techniques. Prior to such controlled reheating/rolling, the rolling preforms are canned in selected canning material to suitable packs (38) so as to provide environmental protection during rolling. The packs are then controllably rolled (39) with preheat and inner pass reheat cycles. These cycles include: (a) initial rolling passes, and (b) final rolling passes.

Referring to FIG. 3*b*, the initial rolling passes are performed at a temperature just below the alpha transus phase line ($T_\alpha$) between the alpha and alpha+gamma phase fields ($T_\alpha-10°$ C. to $T_\alpha-40°$ C.) where percent alpha phase is in the approximate range of 50–80. The gamma packs are reheated between passes for sufficiently long duration to provide a uniform part temperature and partial homogenization but to prevent grain growth. Such a reheat time is generally in a range from about 2 to about 10 minutes with a preferred practice of about 2 to 4 minutes.

Figure 6:
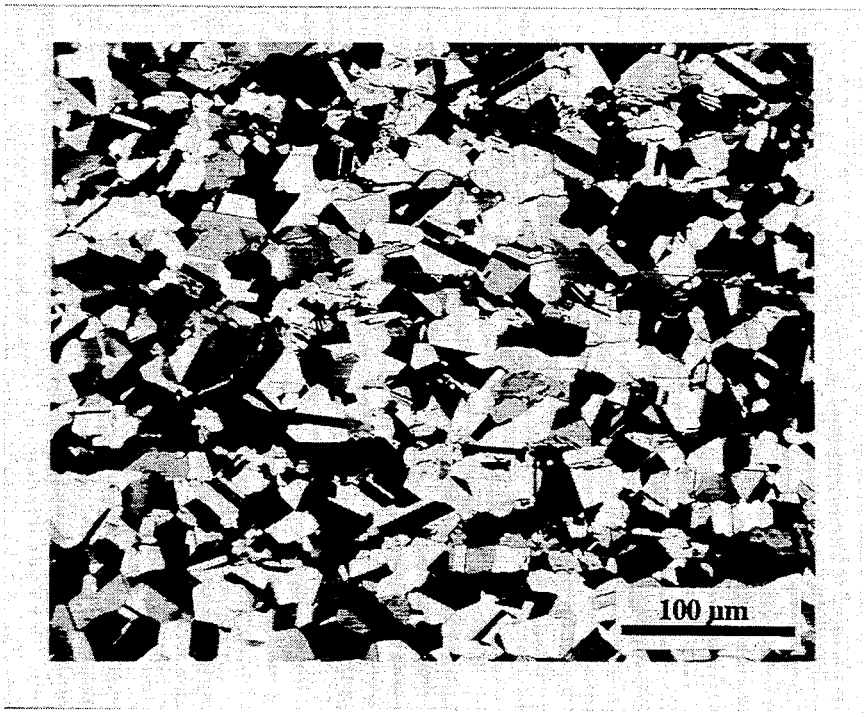
FIG. 6 is a photomicrograph of a rolled sample of ingot metallurgy Ti-48Al-2.5 Nb-0.3Ta [atomic %] gamma alloy processed under the controlled conditions of the present invention.

Finish rolling passes are done at lower temperatures in the alpha+gamma phase field ($T_\alpha-40°$ C. to $T_\alpha-150°$ C.) and with shorter reheats (2 to 3 minutes) of the material thus partially homogenized in order to promote grain refinement. Examples of the microstructures in sheet products rolled under such controlled conditions are illustrated in FIG. 6, the conditions being described in the Example below:

An Example of Optimum Roll Processing Parameters Developed by the Current Invention Yielding the Desirable Microstructure Shown in FIG. 6

| | |
|---|---|
| 1) Nominal Composition [Wt %] of Preform Material | Ti-33 Al - 5 Nb - 1 TA |
| 2) Starting Preform Thickness | 0.38 [inches] |
| 3) Final Sheet Thickness Before Belt Grinding | 0.078 [inches] |
| 4) Sample Size After Trimming | 7 × 18 [inches] |
| 5) Plan Area | ≃125 [square inches] |
| 6) Rolling Mill | 16 [inch] dia × 24 [inch] wide, Two High |
| 7) Canning | Pack geometry: 0.25 in. wide CP Ti picture frame 0.125 in. thick CP Ti covers with 0.030 in. thick Ta interlayers and 0.002 in. CaO parting agent between Ta and preform. |
| 8) Rolling Conditions | Preheat - 1700° F./15 min. + 2420° F.(+30° F., −0° F.)/20 minutes<br>Reheat - 2420° F. + 30° F., − |

-continued

| An Example of Optimum Roll Processing Parameters Developed by the Current Invention Yielding the Desirable Microstructure Shown in FIG. 6 | |
|---|---|
| | 0° F./3 min. between each pass<br>Roll temperature 450° F.<br>Reduction per pass - 15%<br>Rolling speed ~ 28 fpm<br>Piece turned 180° about R.D. between passes<br>Argon not used in reheat furnace; i.e. air atmosphere |
| 9) Final Anneal (Optional) | 2100° F./2h |

Figure 7:
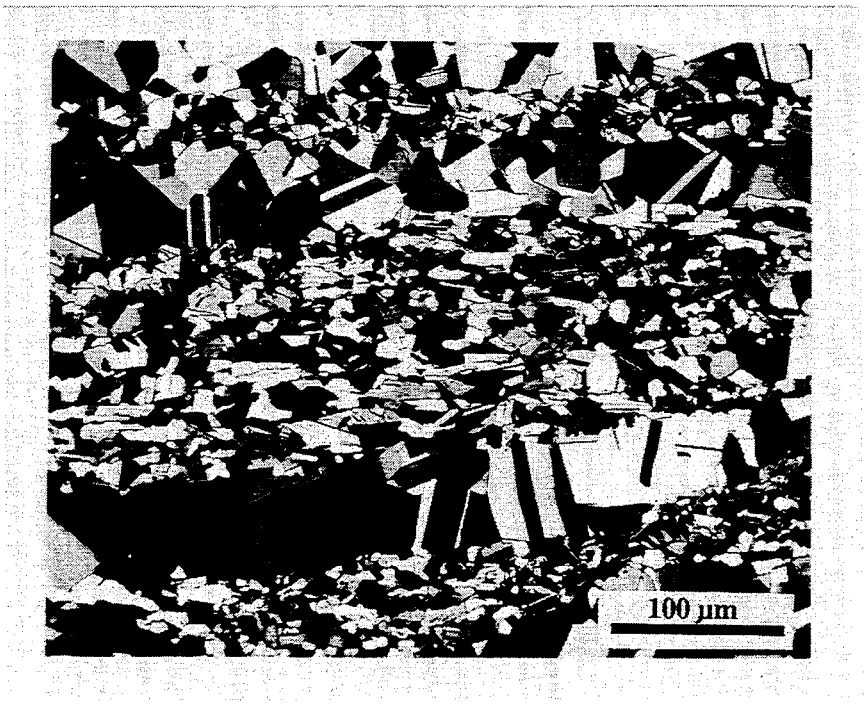
FIG. 7 is a photomicrograph of a gamma alloy sample rolled at temperatures too low in the alpha-gamma phase field to promote homogenization of the microstructure.

For comparison FIG. 7 illustrates a microstructure rolled at temperatures too low in alpha+gamma phase field to promote adequate homogenization of the microstructure, the conditions being described in the Example below:

| An Example of Non-Optimum Roll Processing Parameters Yielding an Undesirable Gamma Microstructure Shown in FIG. 7 | |
|---|---|
| 1) Nominal Composition [Wt %] of Preform Material | Ti-33 AL - 5 Nb - 1 Ta |
| 2) Starting Preform Thickness | 0.43 [inches] |
| 3) Final Pack Thickness After Rolling | 0.100 [inches] |
| 4) Rolling mill | 8 in. dia. × 12 in. wide, two-high |
| 5) Canning | CPTi can = 0.25 in. picture frame + 0.125 in. thick covers; 0.030 in. thick Ta interlayers. |
| 6) Rolling Conditions | Preheat: 1700° F./15–20 min. + 2400° F. + 0° F., - 20° F./20 to 30 min;<br>Reheat: 2400° F. + 0° F., − 20° F./3–5 min. between passes<br>Roll temperature 1600° F.<br>Reduction per pass: '10–20 percent' schedule = ~10 pct. (first two passes), ~12–15 pct (second two passes), ~20 percent (all remaining passes)<br>Rolling speed 20 fpm |
| 7) Final Anneal | 2100° F./2h |

Figure 5:
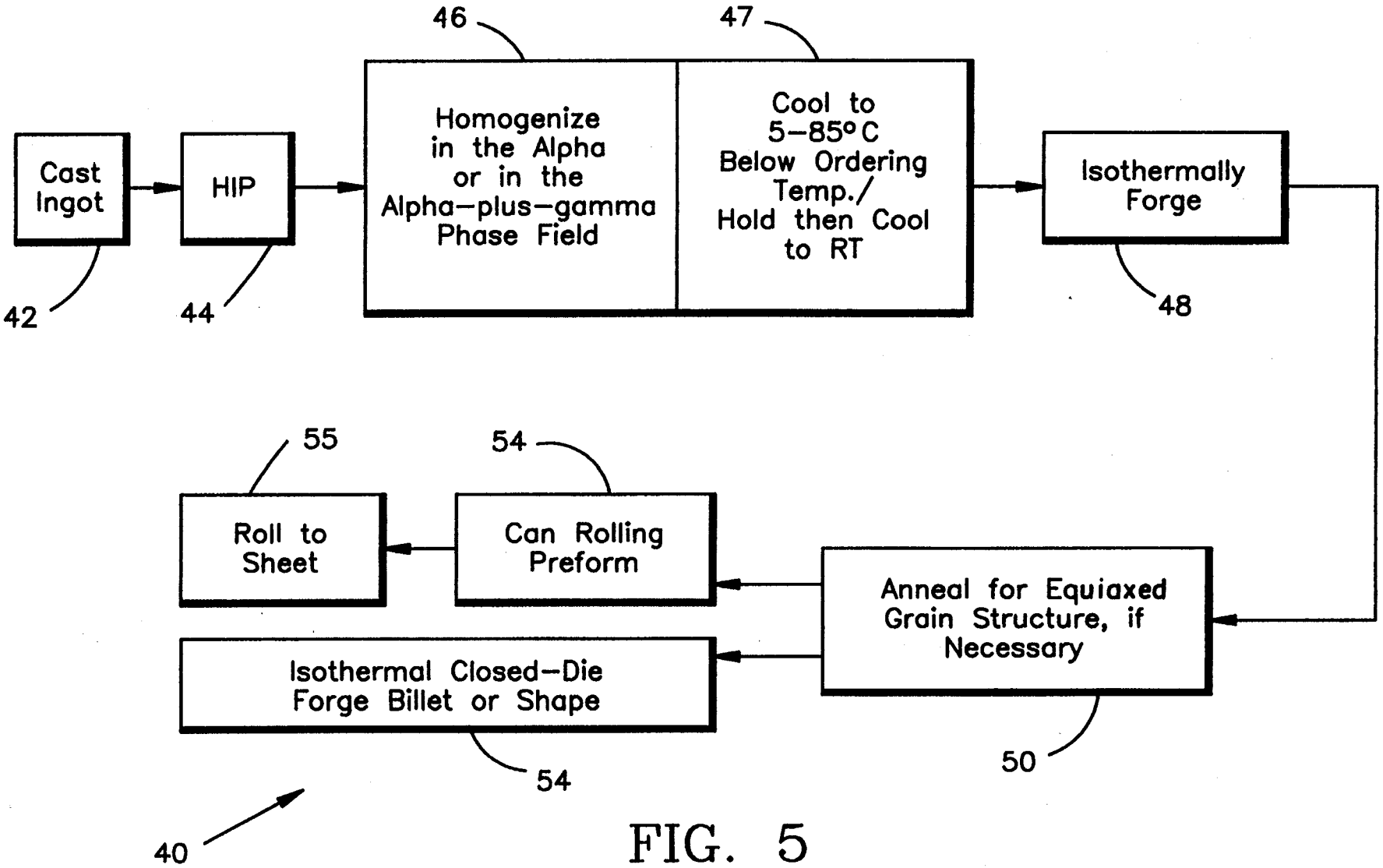
FIG. 5 is a flow diagram of a second preferred product pathway in which forgings (billets, shapes) or sheet products are formed in accordance with the principles of the present invention. (In this pathway the processing involves homogenization in the alpha phase field prior to isothermal breakdown forging.)

(B) Referring to FIG. 5, a second "product pathway" is illustrated for forming billet or sheet products. This pathway is designated generally as 40. As in the first case, ingot is cast 42 and then HIP'ed 44 to seal off casting defects. The material is cut and then homogenized in the alpha phase field at $T_\alpha$ to $T_\alpha+70°$ C., preferably at about $T_\alpha+20°$ C. to $T_\alpha+50°$ C., for sufficient time to produce an equiaxed alpha structure with homogeneous chemistry throughout (single-phase homogenization). Alternatively, the homogenizing treatment may be conducted in the alpha plus gamma phase field at $T_\alpha$ to $T_\alpha-40°$ C., preferably at about $T_\alpha$ to $T_\alpha-20°$ C., to promote partial homogenization. The exposure time period is generally in the range of 10 minutes to two hours (with shorter times used as more of the disordered alpha phase is present, e.g. minimal exposure for single phase homogenizing.)

The material is then cooled to a temperature of about 5° to 85° C. below the eutectoid (ordering) temperature $T_{eut}$ (see FIG. 3). It is held at this temperature to produce a partially to fully uniform two-phase lamellar alpha-two/gamma microstructure (see numeral designations 46, 47 in FIG. 5). The material is subsequently cooled to room temperature. It is then reheated and isothermally forged 48 via pancaking to break down the lamellar structure at temperatures low in the alpha+-gamma phase field [same as detailed earlier in item 1 (see also FIG. 3*a*)] or high in the alpha-two+gamma phase field [same as detailed earlier in item 1 (see also FIG. 3*a*)]. This may or may not be followed by a subsequent annealing treatment 50 in the alpha+gamma phase field at a temperature in the range $T_{eut}$ to $T_\alpha-40°$ C. to globularize/recrystallize the structure. Material with the resulting structure of equiaxed gamma with alpha-two at the gamma grain boundaries can then be further processed by isothermal closed-die forging 52 at temperatures similar to those noted earlier in item 1 (and FIG. 3*a*) to produce finished shapes or rolled to sheet (54, 55) (at moderate temperatures in the alpha+-gamma phase field, where percent alpha is ≦40).

Figure 1:
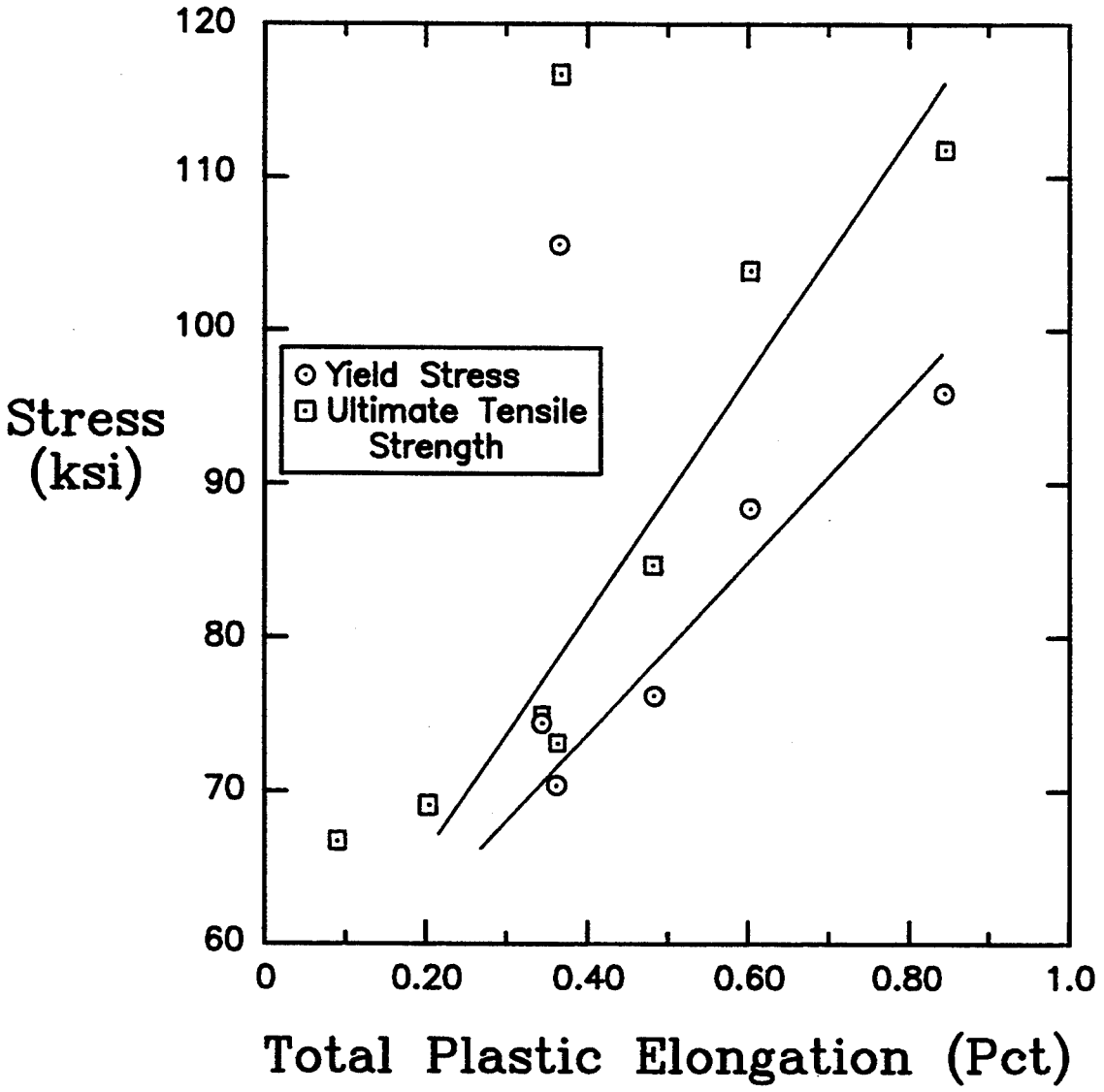
FIG. 1 is a graph of stress versus total plastic elongation illustrating the interrelation of total elongation, yield strength and ultimate tensile strength in Ti-48 Al-2.5Nb-0.3Ta (atomic percent) with an equiaxed grain structure of various sizes.

The rolled gamma sheet plastic elongation, both in the as-rolled and as-rolled-and-heat-treated conditions appear to obey a general relationship, namely that the smaller elongation values at room temperature are associated with the coarser peak grain sizes of the gamma phase (example in FIG. 7), whereas the larger elongations are associated with the finer peak gamma grain sizes (example in FIG. 6). It is clearly seen that: (a) a uniform fine grain size in thermomechanically processed gamma provides a substantially improved balance of room-temperature strength and ductility (see FIG. 1) besides other benefits (noted below), and (b) such a microstructure is achievable with a uniform distribution of the alpha-two second phase with broken down near-gamma alloy microstructures.

A number of benefits are accrued by the thermomechanical processes of the present invention.

1. The development of a fine, uniform, equiaxed gamma grain structure whose size is stable because of the uniform distribution of the "structure control" phase (i.e., alpha-two at the lower range and alpha at the higher range of phase transformation temperatures). This makes the near gamma titanium aluminide amenable to secondary processes which rely on the superplastic characteristics of such materials. These processes include isothermal closed-die forging and superplastic sheet forming.

2. The microstructure produced by this type of process can be readily heat treated to obtain other microstructure variant (e.g. lamellar structure with a fine colony size) that provide enhanced properties for other specialized applications.

3. The microstructure produced by the process of the present invention provides enhanced yield and ultimate tensile strength, ductility and resistance to fatigue crack initiation.

The present invention can be utilized with a wide variety of ranges of gamma compositions. For example, it may be utilized with gamma alloys with aluminum content in the range of 46 to 50 atomic percent, with further additives including various combinations of the following elements: niobium, tantalum, chromium, vanadium, manganese and/or molybdenum in the amounts of zero to 3 atomic percent, and with titanium balance element. The present invention can also be used with gamma alloys containing between zero and 30 percent alpha-two phase, the balance being gamma phase.

Obviously, many modifications and variations of the present invention are possible in light of the above teachings. It is, therefore, to be understood that, within the scope of the appended claims, the invention may be practiced otherwise than as specifically described.

What is claimed and desired to be secured by Letters Patent of the United States is:

1. A method for thermomechanically processing near gamma titanium aluminide alloy wrought products, comprising the steps of:

(a) casting a near gamma titanium aluminide alloy ingot;

(b) hot isostatic pressing (HIP'ing) said near gamma titanium aluminide alloy ingot to seal off casting defects;

(c) preparing the HIP'ed near gamma titanium aluminide alloy ingot into suitable forging preforms;

(d) isothermally forging said forging preforms into suitable end product preforms at forging temperatures sufficiently close to a phase line between alpha+gamma and alpha-two+gamma phase fields so as to break down the ingot coarse microstructure and to yield a largely equiaxed gamma microstructure; and (e) processing said end product preforms into desired wrought end products.

2. The method of claim 1, wherein said step of processing said end product preforms comprises:

(a) cutting and canning said end product preforms in selected canning material packs suitable for rolling so as to provide environmental protection during rolling; and (b) controllably rolling said selected canning material packs with preheat and interpass reheat cycles, said preheat and interpass reheat cycles comprising:

initial rolling passes just below the phase line between alpha and alpha plus gamma phase fields, reheating said selected canning material packs between passes for sufficiently long duration to promote homogenization and to prevent grain growth; and finish rolling passes at lower temperatures in said alpha plus gamma phase field and with shorter reheats of the material thus homogenized in order to promote grain refinement.

3. The method of claim 1, wherein said step of preparing the HIP'ed near gamma titanium aluminide alloy ingot into suitable forging preforms comprises:

(a) cutting said HIP'ed near gamma titanium aluminide alloy ingot; and (b) substantially homogenizing at a temperature range of about $T_\alpha-40°$ C. to $T_\alpha+70°$ C.

4. The method of claim 1, wherein said step of isothermally forging comprises forging at a range between $T_{eut}+100°$ C. to $T_{eut}-100°$ C.

5. The method of claim 1, wherein said step of isothermally forging comprises forging at a range between $T_{eut}+50°$ C. to $T_{eut}-50°$ C.

6. The method of claim 2, wherein said initial rolling passes comprise passes in a temperature range between $T_\alpha-10°$ C. and $T_\alpha-40°$ C.

7. The method of claim 2, wherein said finish rolling passes comprise passes in a temperature range between $T_\alpha-40°$ C. and $T_\alpha-150°$ C.

8. The method of claim 2, wherein said reheats between said initial rolling passes is in a range between 2 and 10 minutes.

9. The method of claim 2, wherein said shorter reheats between said finish rolling passes is in a range between 2 and 3 minutes.

10. The method of claim 3, wherein said step of substantially homogenizing said HIP'ed near gamma titanium aluminide alloy ingot into suitable forging preforms, comprises:

(a) homogenizing said HIP'ed near gamma titanium aluminide alloy ingot in the alpha plus gamma phase field within the temperature range $T_\alpha$ to $T_\alpha-40°$ C. for sufficient time to produce a partially homogenized chemistry throughout;

(b) cooling said material to a temperature of about 5° to 85° C. below $T_{eut}$;

(c) maintaining said material at $T_{eut}-5°$ C. to $T_{eut}-85°$ C. for a sufficiently long time to produce a two-phase lamellar alpha-two/gamma phase microstructure in the prior-alpha regions of the microstructure, and (d) cooling said material to approximately room temperature to provide suitable forging preforms.

11. The method of claim 3, wherein said step of substantially homogenizing the HIP'ed near gamma titanium aluminide alloy ingot into suitable forging preforms, comprises:

(a) homogenizing said HIP'ed ingot in the alpha phase field within the temperature range $T_\alpha$ to $T_\alpha+70°$ C. for sufficient time to produce a substantially equiaxed material with an alpha structure with homogeneous chemistry substantially throughout;

(b) cooling said material to a temperature of about 5° to 85° C. below $T_{eut}$;

(c) maintaining said material at $T_{eut}-5°$ C. to $T_{eut}-85°$ C. for a sufficiently long time to produce a uniform two-phase lamellar alpha-two/gamma phase microstructure, and (d) cooling said material to approximately room temperature to provide suitable forging preforms.

12. The method of claim 1, wherein said step of processing said end product preforms into the desired wrought end products, includes prior to final end product forming the step of:

annealing said end product preforms in the alpha plus gamma phase field at a temperature in the range of $T_{eut}$ to $T_\alpha-40°$ C. to globularize/recrystallize the structure.

13. The method of claim 1, wherein said step of processing said end product preforms into the desired wrought end products, comprises the steps of:

isothermal closed-die forging said annealed end product preforms at a temperature range of between $T_{eut}+100°$ C. to $T_{eut}-100°$ C.

14. The method of claim 12, wherein said step of processing said end product preforms into the desired wrought end, said end product preforms into the desired wrought end products, further comprises the steps of:

isothermal closed die forging said annealed end product preforms at a temperature range of between $T_{eut}+100°$ C. to $T_{eut}-100°$ C.

15. The method of claim 2, wherein said step of processing said end product preforms into the desired wrought end products, comprises the steps of:

canning said annealed end product preforms; and, rolling said canned end product preforms to sheet.

16. The method of claim 12, wherein said step of processing said end product preforms into the desired wrought end products, further comprises the steps of:

canning said annealed end product preforms, and, rolling said canned end product preforms to sheet.

* * * * *